US007109406B2

(12) United States Patent
Stone et al.

(10) Patent No.: US 7,109,406 B2
(45) Date of Patent: Sep. 19, 2006

(54) SYSTEM AND METHOD FOR DYNAMIC NOTE ASSIGNMENT FOR MUSICAL SYNTHESIZERS

(76) Inventors: Christopher L. Stone, 5258 Twin Oaks, Hidden Hills, CA (US) 91302-2416; Gary D. Davis, 7545 Royer Ave., West Hills, CA (US) 91307-1534

( * ) Notice: Subject to any disclaimer, the term of this patent is extended or adjusted under 35 U.S.C. 154(b) by 299 days.

(21) Appl. No.: 10/684,296

(22) Filed: Oct. 10, 2003

(65) Prior Publication Data

US 2005/0076770 A1 Apr. 14, 2005

(51) Int. Cl.
*A63H 13/00* (2006.01)

(52) U.S. Cl. ..... 84/609; 446/408

(58) Field of Classification Search ..... 84/609, 84/622, 645; 446/408
See application file for complete search history.

(56) References Cited

U.S. PATENT DOCUMENTS

2004/0099125 A1* 5/2004 Kay ..... 84/609
2005/0056143 A1* 3/2005 Fay ..... 84/645

OTHER PUBLICATIONS

"Garritan Personal Orchestra Ensemble Building," Garritan Orchestral Libraries, http://web.archive.org/web/20041011021446/garritan.com/GPO-ensemble.html, Oct. 11, 2004.

"Garritan Personal Orchestra Controls," Garritan Orchestral Libraries, http://web.archive.org/web/20041011020846/garritan.com/GPO-control.html, Oct. 11, 2004.

"Garritan Orchestra FAQ Page," Garritan Orchestral Libraries, http://www.garritan.com/FAQ.html, Oct. 11, 2004.

"Garritan Personal Orchestra Features," Garritan Orchestral Libraries, http://web.archive.org/web/20041009173443/garritan.com/GPO.html, Oct. 11, 2004.

* cited by examiner

*Primary Examiner*—Marlon T. Fletcher
*Assistant Examiner*—Jianchun Qin
(74) *Attorney, Agent, or Firm*—Sughrue Mion, PLLC; Joseph Bach, Esq.

(57) ABSTRACT

The invention is a method and system for assigning notes to be played by a musical synthesizer to a predetermined number of channels of said musical synthesizer, so that the musical synthesizer may emulate the note allocation of a live orchestra section. The method includes the steps of selecting a note/channel assignment table corresponding to the number of notes to be played and the number of channels allocated to the playing of such notes, and assigning notes to the channels pursuant to the assignment table. The number of channels would typically be the same as the number of instruments in the orchestra section being emulated As new note events occur, notes are dynamically reassigned to channels so that hard and soft attacks are taken into account and, to the extent practicable, each channel plays a single note at a time.

35 Claims, 4 Drawing Sheets

301

Figure 1:
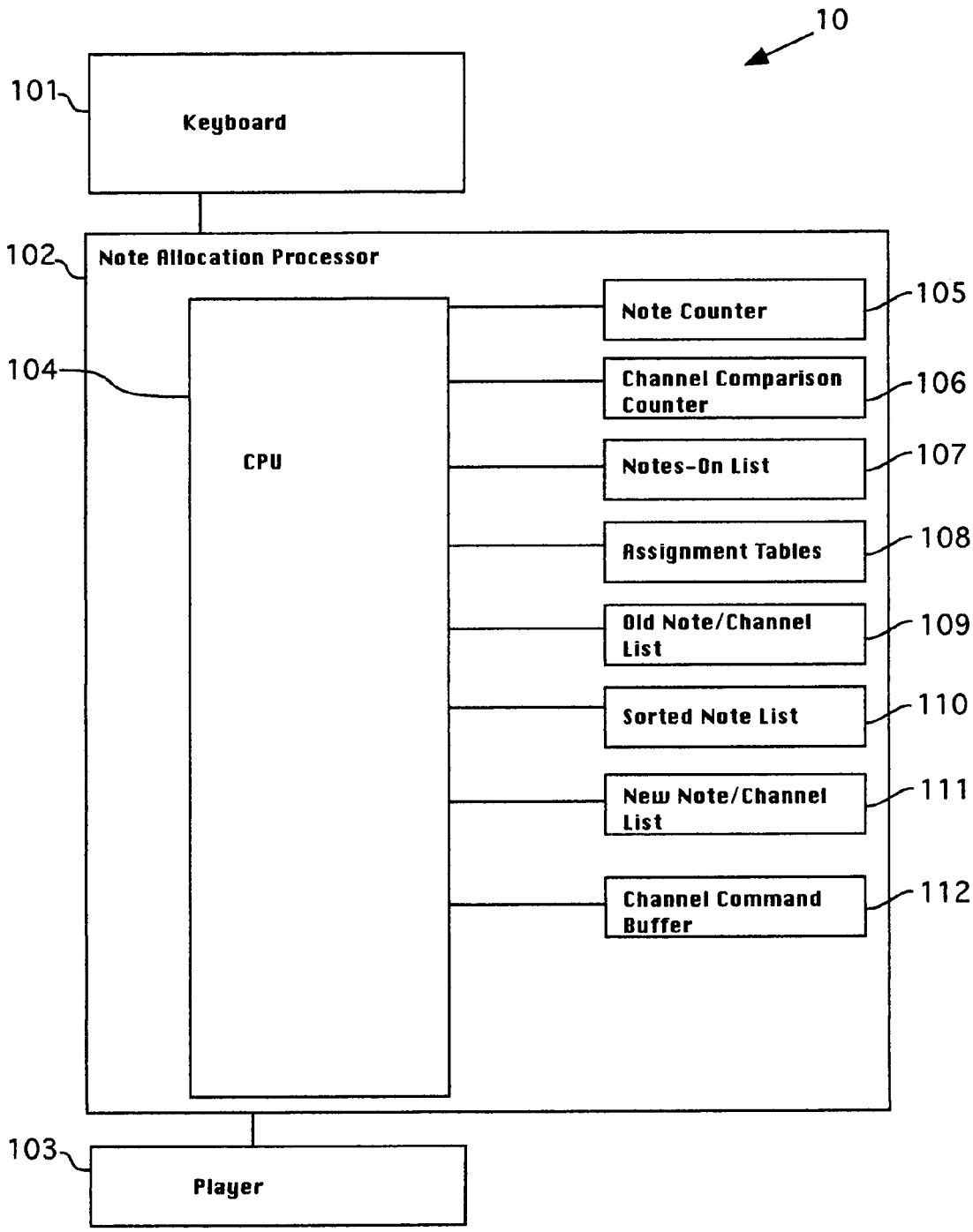

Assignment Table, Eight Cello Section
One Note
Top-Weighted

Channel 1: the note on sorted note list
Channel 2: the note on sorted note list
Channel 3: the note on sorted note list
Channel 4: the note on sorted note list
Channel 5: the note on sorted note list
Channel 6: the note on sorted note list
Channel 7: the note on sorted note list
Channel 8: the note on sorted note list

302

Assignment Table, Eight Cello Section
Two Notes
Top-Weighted

Channel 1: the higher note on sorted note list
Channel 2: the higher note on sorted note list
Channel 3: the higher note on sorted note list
Channel 4: the higher note on sorted note list
Channel 5: the lower note on sorted note list
Channel 6: the lower note on sorted note list
Channel 7: the lower note on sorted note list
Channel 8: the lower note on sorted note list

303

Assignment Table, Eight Cello Section
Three Notes
Top-Weighted

Channel 1: the highest note on sorted note list
Channel 2: the highest note on sorted note list
Channel 3: the highest note on sorted note list
Channel 4: the second highest note on sorted note list
Channel 5: the second highest note on sorted note list
Channel 6: the second highest note on sorted note list
Channel 7: the lowest note on sorted note list
Channel 8: the lowest note on sorted note list

304

Assignment Table, Eight Cello Section
Four Notes
Top-Weighted

Channel 1: the highest note on sorted note list
Channel 2: the highest note on sorted note list
Channel 3: the second highest note on sorted note list
Channel 4: the second highest note on sorted note list
Channel 5: the third highest note on sorted note list
Channel 6: the third highest note on sorted note list
Channel 7: the lowest note on sorted note list
Channel 8: the lowest note on sorted note list

305

Assignment Table, Eight Cello Section
Five Notes
Top-Weighted

Channel 1: the highest note on sorted note list
Channel 2: the highest note on sorted note list
Channel 3: the second highest note on sorted note list
Channel 4: the second highest note on sorted note list
Channel 5: the third highest note on sorted note list
Channel 6: the third highest note on sorted note list
Channel 7: the fourth highest note on sorted note list
Channel 8: the lowest note on sorted note list

306

Assignment Table, Eight Cello Section
Six Notes
Top-Weighted

Channel 1: the highest note on sorted note list
Channel 2: the highest note on sorted note list
Channel 3: the second highest note on sorted note list
Channel 4: the second highest note on sorted note list
Channel 5: the third highest note on sorted note list
Channel 6: the fourth highest note on sorted note list
Channel 7: the fifth highest note on sorted note list
Channel 8: the lowest note on sorted note list

307

Assignment Table, Eight Cello Section
Seven Notes
Top-Weighted

Channel 1: the highest note on sorted note list
Channel 2: the highest note on sorted note list
Channel 3: the second highest note on sorted note list
Channel 4: the third highest note on sorted note list
Channel 5: the fourth highest note on sorted note list
Channel 6: the fifth highest note on sorted note list
Channel 7: the sixth highest note on sorted note list
Channel 8: the lowest note on sorted note list

308

Assignment Table, Eight Cello Section
Eight Notes
Top-Weighted

Channel 1: the highest note on sorted note list
Channel 2: the second highest note on sorted note list
Channel 3: the third highest note on sorted note list
Channel 4: the fourth highest note on sorted note list
Channel 5: the fifth highest note on sorted note list
Channel 6: the sixth highest note on sorted note list
Channel 7: the seventh highest note on sorted note list
Channel 8: the lowest note on sorted note list

Fig. 3

SYSTEM AND METHOD FOR DYNAMIC NOTE ASSIGNMENT FOR MUSICAL SYNTHESIZERS

TECHNICAL FIELD

This invention relates to the playing or orchestration of musical material on a sample-based or synthesizer-based instrument in a way that dynamically assigns individual note reproduction to simulate the manner in which a given number of live musical instruments would play a musical selection. The same note assignment methods described here may equally be applied to the generation of musical scores for orchestration, or for generating stored note-playing data for subsequent generation of synthesized sound or orchestration.

BACKGROUND

There are fundamentally two categories of musical synthesizers: (a) samplers (or "sampling synthesizers"), in which stored digitized recordings (or samples) of actual instruments are reproduced when notes are played on a keyboard connected to the sampler, and (b) synthesizers, in which sounds are created at the time they are played based on analog or digital electronic circuitry which creates the sound without reliance upon previously recorded actual instruments. These instruments today are predominantly polyphonic, meaning they can play more than one note at a time. While the nature of the invention is immediately more applicable to samplers, it will function in connection with synthesizers as well. For simplicity the discussion herein will focus primarily on sampling applications.

When samples are initially recorded, there may be one or many instruments actually playing the sound (and each may be playing one or more notes). Typically with orchestral or large band sounds, entire sections of instruments play each sampled note, with all instruments in a given section concurrently playing a single note. Thus, in the prior art a sample of an orchestra section of eight cellos would be a single recording of eight cello players playing the same note. When this sample of one note is played back on a sampler, all eight instruments are heard playing the same note. Similarly, a sample of an orchestra section of sixteen violins would be made by recording sixteen individual violin players all concurrently playing the same note, and when this sample is played back the sound of all sixteen violins would be heard playing that note concurrently.

Depending upon the nature of the technology used in a prior art sampler, there may be a separate source recording (initial sample) in its library for each note the sampler is capable of reproducing, or a single note sample may be electronically interpolated to higher and lower pitches corresponding to various notes. The first option yields optimum sound quality, at maximum cost and complexity, to create the library and reproduce it in the sampler, whereas the second option yields lesser sound quality at a reduced cost and complexity.

In the prior art, when multiple notes are concurrently played on a sampler, multiple instances of the sampled recording are sounded. Thus, if one has a cello sample in the library made from eight cellos, and two notes are played together on the sampler, the sampler would play the sound of sixteen cellos playing, eight instruments per note. If one plays a triad (i.e., three notes concurrently) on the sampler, the sampler would play the sound of twenty-four cellos (i.e., three times the eight cellos per sample). This is called additive polyphony. Although this is what is available in professional studios, it results in an unrealistic sound quality which does not reflect how an actual orchestra would sound. By way of example, with a real orchestra, the power (or volume) of a cello section stays relatively constant whether the cello players play one or several notes simultaneously (e.g., the power is about the same whether eight cellists of an eight cello orchestra section all play the same note or if five are playing one note while three are playing a different note). With a prior art sampler, the power is multiplied approximately by the number of notes played. By way of another example, as more and more notes are played simultaneously with a sampler, the density of the harmonics sounded tends to create an organ-like effect rather than preserve the clarity and concise sound definition afforded by a reasonable and fixed number of instruments playing at once. (Note that there may be valid reasons to use additive polyphony, but optimum orchestral sound is not obtained using additive polyphony exclusively.)

SUMMARY OF THE INVENTION

The invention is a method and system for assigning notes to be played by a musical synthesizer to a predetermined number of channels of said musical synthesizer, so that the musical synthesizer may emulate the note allocation of a live orchestra section. The method includes the steps of selecting a note/channel assignment table corresponding to the number of notes to be played and the number of channels allocated to the playing of such notes, and assigning notes to the channels pursuant to the assignment table. The number of channels would typically be the same as the number of instruments in the orchestra section being emulated As new note events occur, notes are dynamically reassigned to channels so that hard and soft attacks are taken into account and, to the extent practicable, each channel plays a single note at a time.

BRIEF DESCRIPTIONS OF THE DRAWINGS

FIG. 1 is a schematic drawing of an embodiment of the present invention.

Figure 2A:
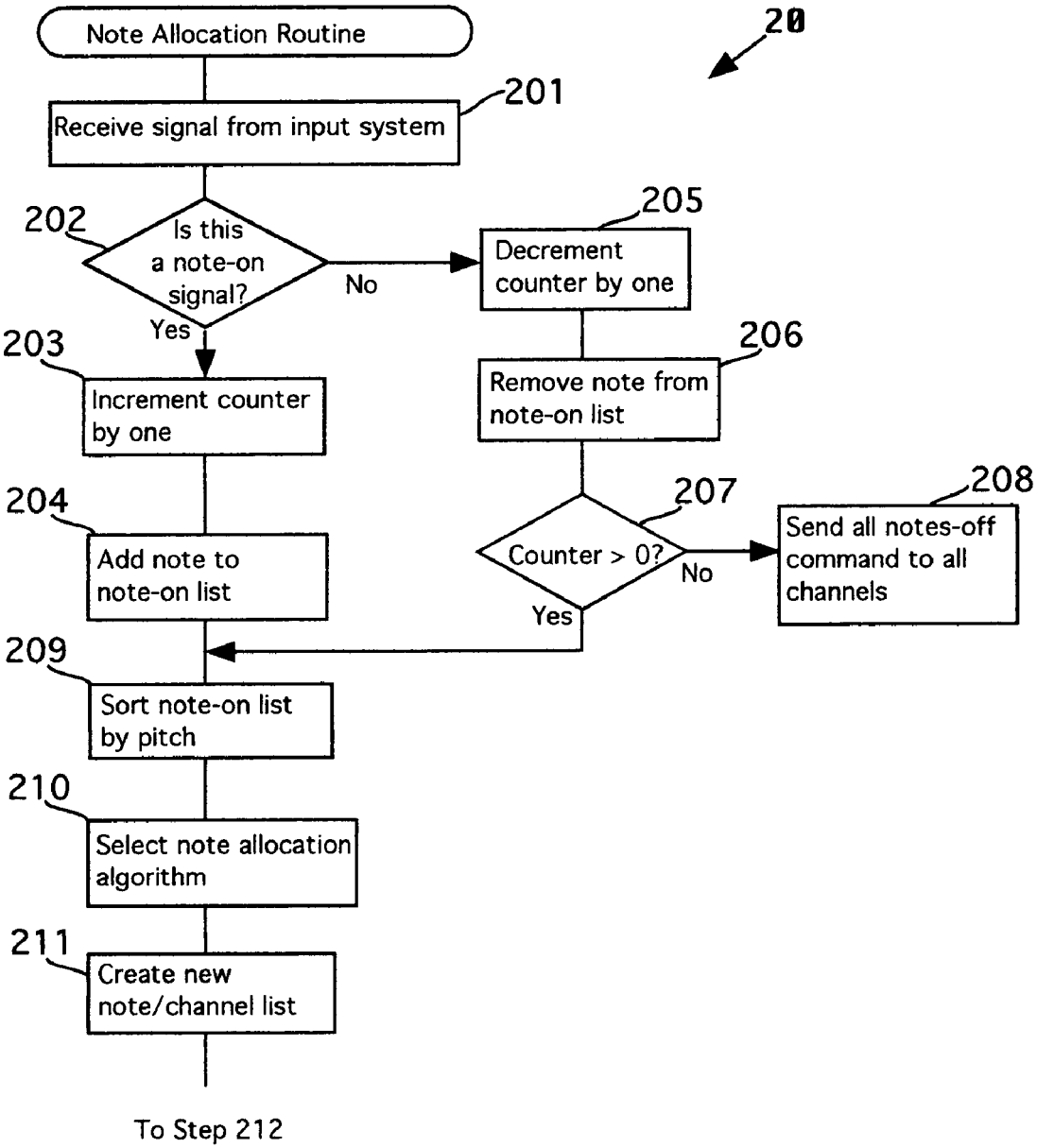
Figure 2B:
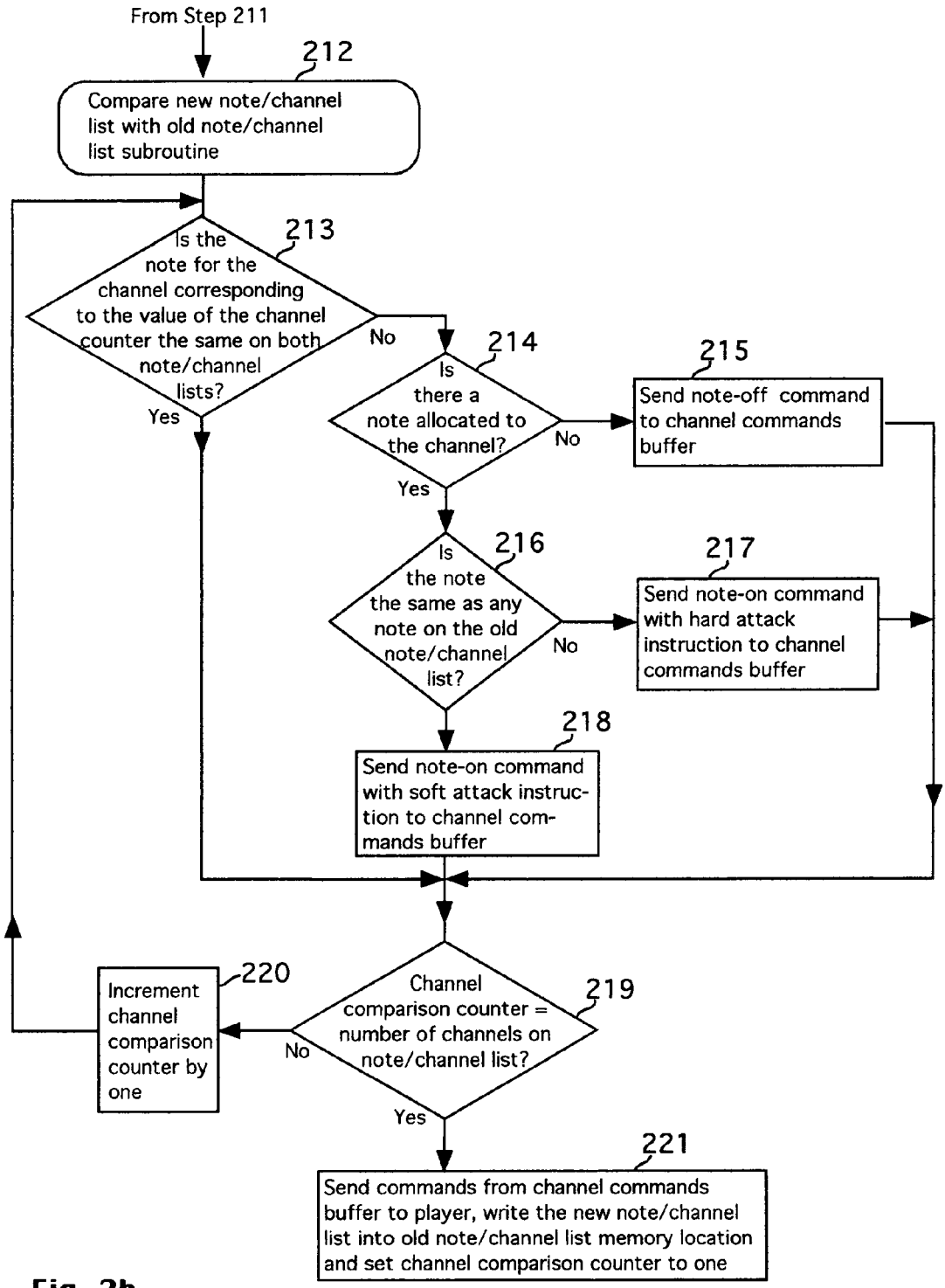

FIGS. 2*a* and 2*b* are a flow diagram showing the Note Allocation Routine of the present invention.

FIG. 3 is a sample set of assignment tables.

DETAILED DESCRIPTION OF THE INVENTION

The present invention departs from traditional additive polyphony and is based upon a musical concept known as "divisi." Divisi describes the way an actual orchestra would play a musical selection. If, for instance, an eight cello section of an orchestra were playing one, two or three notes at the same time, there could never be more than eight cellos playing at once. If only one note were being played, all eight would typically play that note. If two notes were being played, then perhaps four cellists would each play one note and four cellists would each play the other note. In reality, sometimes the more melodically important of the two notes would get preferential weighting; five cellists might play that note and the remaining three would play the other note. Similarly, with a triad (three notes), three cellists might play each of the two more melodically important notes, while the remaining two cellists played the third note. This is how divisi works in a real orchestra, and it is implemented there in part by the composer and/or conductor, and in part by the lead player for each section; these people determine which particular instruments sound a given note at any time. There can never be more notes being created at one time than there are instruments in that section of the orchestra (unless of course the instruments themselves are capable of playing more than one note at a time).

The invention relies upon two things to function when the system uses a sampler, (a) the original samples must be recorded for individual instruments (or sub-sets of the full section if not individual instruments), and (b) the sampler is controlled so that the number of instruments being sounded by the sampler does not exceed a predetermined number, which number in the preferred embodiment is the number of uniquely sampled sources of that instrument. (It may be possible to try to play more notes than the number of individual instruments which were originally sampled by combining additive polyphony with the present invention so that simultaneous notes played, in total, exceed the number of uniquely sampled instruments. In the event that more notes are selected to be played than the number of individually sampled instruments, combining additive polyphony to the present invention would prevent notes from being skipped while still minimizing unintended organ-like effects.)

The actual assignment of sampled sounds to notes played is done using predetermined orchestral algorithms and/or lookup tables and/or allocation maps (referred to collectively herein as "assignment tables") which may be devised by someone with knowledge of instrumentation. The assignment tables provide instrumentation techniques which would be familiar to orchestral composers. A primary benefit of the invention in playing sampled (or synthesized) music is that it creates a much more realistic sound. The invented system may include a feature which allows for editing or adding lookup tables by the end user.

Currently most samplers and synthesizers rely upon a method of defining their parameters, and transferring control information, known as MIDI (Musical Instrument Digital Interface). While the present invention functions with MIDI systems, it can be implemented on other or future means of controlling musical instruments (e.g., MLAN from Yamaha Corporation), and in fact the invention would likely benefit from faster communications protocols available with MLAN than is possible with conventional MIDI.

For purposes of explanation, MIDI terminology will be referred to herein because that terminology is understood by those skilled in the art. Of course, the terminology is not necessarily exclusive to the MIDI environment; terms such as "ports" and "channels" can be applicable with other means of control. So, for example, in the invention one MIDI port would be used for a given section of sampled instruments (i.e., the violins) and each of the sixteen MIDI channels conveyed by that MIDI port can request the sounding of a single sample (e.g., one instrument, such as a violin, playing a single note).

A sampled sound library should be prepared to be suitable for use with the invention. Typically this will be with one musical instrument at a time playing each note, and stored this way in the sampler's library. (One could record two instruments at a time and save that recording as a single sample. For ease of description, we will discuss recording of individual instruments.)

The sampled sound library is loaded into a suitable sampler. The means by which that library is utilized by the sampler is controlled by the present invention.

An exemplary implementation would have an end user playing a musical keyboard, which keyboard generates note commands as it is played. These commands go to a processor (hardware, firmware and/or software), which does the following: it analyzes the number of notes being played on the keyboard at any one moment and then assigns the played notes to channels of the sampler (or synthesizer), and thus ultimately to available sampled sounds. Assignment is made such that the total number of sampled instruments playing all the notes does not exceed the original number of individual instruments (or sounds) that were sampled. (As noted above, in those rare circumstances when an end user would cause more notes to be played by one orchestra section than the number of real instruments which were sampled, then additive polyphony may be used to have the sampler play the "extra" notes. Alternatively, the "extra" notes may be ignored using a predefined priority scheme favoring, for example, the most recently played notes or the highest pitched notes.) The notes are dynamically assigned in response to changes in which keys are pressed, held down, or released on the keyboard (or any other suitably-interfaced musical performance controller).

A single set of assignment tables for assignment of available sampled instruments to notes played may not be suitable for all types of music or for all types of instruments. It is expected that commercial embodiments of the invention will include a menu of assignment tables, with default settings available for various instrument sections. The choices of algorithms/lookup tables, and provision for user-commanded changes, would allow for selection of such options as top weighting (where more instruments sound the highest-pitched note) and bottom-weighting (where more instruments play the lowest pitched note).

The preferred embodiment of the subject invention is illustrated in the attached drawings which are referred to herein. The same reference numeral will be used to identify identical elements throughout the drawings.

FIG. 1 illustrates an embodiment of the invention shown in a contemplated performance system 10. This embodiment includes a user input device 101, a note allocation processor 102, and a note player 103. In the embodiment described herein, the input device is a musical instrument keyboard. It may be another device as well, such as an ASCII keyboard or a MIDI controller. The note player is a MIDI sampler in the embodiment described here.

Note player 103 includes a library of recordings of notes played by individual instruments which, in the example discussed here, are comprised in an orchestra. It should be noted that the library may include other recorded sounds as well, such as sound effects, vocals, and non-orchestral instruments. For simplicity, the description herein is of a sampler loaded with recordings of individual orchestra instruments.

Note allocation processor 102 includes a central processing unit ("CPU") 104, note counter 105 and a channel comparison counter 106, and the following memory locations: notes-on list 107, assignment tables 108, old note/channel list 109, sorted notes-on list 110, new note/channel list 111 and channel commands buffer 112.

The input device, note allocation processor, MIDI interface and player work together as described below in connection with the discussion of the invented process.

The invented process, as it is most likely to be used with currently available commercial products, will rely upon various MIDI channels (which may be from one or several ports) of the player being assigned to different orchestra sections. The invention assigns notes for a given orchestra section to channels within a port such that each channel of the player will play the sample sound of a single instrument playing the noted assigned to it. It is possible to assign some channels of a particular MIDI port to one section of an orchestra and other channels of that port to another section of an orchestra. Therefore, in the discussion which follows, reference will be made to channels, regardless of ports.

An end user should perform certain setup steps. That is, the end user must first decide what section of an orchestra the input device (here a musical keyboard) will represent. Note that the end user could designate the entire keyboard for a single orchestra section (for an eight cello orchestra section or for a sixteen violin orchestra section).

Alternatively, the end user could figuratively split the keyboard into representations of two orchestra sections (e.g., the left forty-four keys of an eighty-eight key keyboard could be for a cello section and the right forty-four keys could be for a violin section). In such a case, the keyboard would be deemed to be two separate keyboards, each acting effectively separate from the other. When multiple keyboards are used, each keyboard feeds its signals to a separate note allocation processor (or note allocation processor module).

The orchestra section which a keyboard represents does not have to be a traditional orchestra section (which is usually composed of a plurality of the same instrument). The orchestra section that the keyboard represents could be defined as four violins, two cellos and two wind instruments such as oboes. The orchestra section could also be composed of other "instruments," such as a waterfall or a baby crying.

In determining what orchestra section the keyboard is representing, the end user would also determine how many instruments are in the section and the end user would then adjust the controls of the player such that a single channel of the player corresponds to each instrument.

The assignment tables loaded into the assignment tables memory location would be selected to take into account the particular composition of the section represented by the keyboard and the assignment of the player's channels.

In this regard, the user would assure that the appropriate assignment tables are loaded into the assignment tables memory location. Such assignment tables may be among a large variety of assignment tables resident in a master file located in another memory location in the note allocation processor or in an associated computer and selected therefrom by the end user for loading into the assignment tables memory location, or the assignment tables may be specially written by the end user and loaded into the assignment tables memory location.

The end user would also assure that appropriate samples are located in the player's sample library (if it is a sampler) or that the player has the capability to produce the desired sounds (if the player is a synthesizer).

The term "note" traditionally means a tone of a particular frequency. (For example, the frequency of the note A above middle C on a piano is 440–443 Hz depending upon what standard or scale is used.) For purposes of this disclosure, the term "note" includes any sound which may be produced (e.g., a waterfall or baby crying) as well as sounds made by traditional orchestra instruments.

The dynamic note allocation process 20 is illustrated in FIGS. 2*a* and 2*b*. A signal from keyboard 101, indicating a new event (i.e., a change in what the end user desires to be played) is received by the CPU 104 of note allocation processor 102 in step 201. (User input devices may also provide other instructions besides which notes should be played. For purposes of the discussion herein, these other instructions are deemed to be passed through the note allocation processor.) Even if the end user's hand comes down on, or off of, multiple keys, the actual communication from the keyboard of changes in the notes being played is serial (one after another, albeit in possibly very rapid and randomly-ordered sequence). After receiving the new event signal, the CPU then performs step 202, wherein the CPU determines whether or not the event contains a note-on instruction (e.g., the result of the end user's pressing down of a key on the keyboard). If the answer is "yes" (i.e., it is a note-on instruction), then the CPU performs step 203, which is incrementing the note counter 105 by one. (When the note allocation processing is first begun, the note counter is set to zero.) Then the CPU performs step 204 in which it adds the note which is being turned on to the notes-on list in notes-on list memory location 107. If the answer to the query of step 202 is "no" (i.e., in which case the event must be the cessation of the playing of a note and the incoming signal is interpreted as a note-off instruction), the CPU performs step 205 in which it decrements the counter by one. The CPU then performs step 206 in which it removes the note which is being turned off from the notes-on list in memory location 107.

If as a result of a note-off instruction, there are no notes to be played, there is no longer any need for note allocation. In this regard, the CPU performs step 207 in which it determines whether the note counter has a value greater than zero. The counter represents the number of notes being played at any one time (or the number of notes listed in the notes-on list). If the answer is "no," then the CPU performs step 208, in which the CPU causes the note allocation processor to send either (i) an all notes off command to the player with respect to all channels corresponding to the keyboard or (ii) individual note-off commands to the player fore each channel currently sounding a note. In addition, in step 208 the CPU sets the channel comparison counter to one and sets the contents of the old note/channel list memory location to null. In an alternative embodiment, step 207 could be a determination of whether there is at least one note on the notes-on list. Again, if the answer is "no," the CPU performs step 208. The all notes-off command also assures that no unintended notes are sounded by the player 103.

If the answer to the query of step 207 is "yes," or if the answer to the query of step 202 is "yes" and step 204 has been performed, the CPU performs step 209.

As noted above, the issuance of the all notes off command (or the individual note-off commands) in step 208 is a fail safe feature. This feature may be deemed to be unnecessary. In which case, steps 207 and 208 would be eliminated and the process would proceed to step 209 from step 204 or step 206.

In step 209 the CPU sorts all notes currently being played (i.e. the notes on the notes-on list in notes-on list memory location 107) according to their pitch and stores the sorted notes list in sorted notes list memory location 110. The sorting may instead be done concurrently with the addition or removal of a note from the notes-on list in steps 204 and 206, respectively, and the notes-on list in memory location 107 then serves as the sorted note list.

For the sake of simplicity in this explanation, the input device is considered to be playing only up to as many notes as there are channels (and, correspondingly, instruments) for the section of the orchestra represented by the keyboard. The invention could be configured to accommodate the playing of additional notes by, after step 209, determining how many notes are on the sorted notes-on list and, to the extent that the number of notes exceeds the number of channels that correspond to the keyboard, that number of the lowest notes (in a top weighted system) are removed from the sorted notes-on list and read into the sorted notes-on list of a supplemental note allocation processor which addresses the same channels of the player so that they play multiple notes polyphonically, and skipping of notes is avoided. The supplemental note allocation processor then would assign only one channel to each note, with the lowest pitch note assigned to highest-numbered channel and so forth (i.e., in an eight channel setup, the lowest pitched note would be assigned to the eighth channel and the next lowest pitched note would be assigned to the seventh channel). Alternatively, the invention may work so as to skip the "additional" or "extra" notes pursuant to a priority scheme, as noted above.

After step 209 the CPU then performs step 210. In that step the CPU consults the assignment tables in assignment tables memory location 108 for the appropriate note allocation assignments for the number of notes to be played. Then the CPU performs step 211, wherein the CPU, pursuant to the note allocation assignments received in step 210, prepares a new note/channel list which it stores in new note/channel list memory location 111. Pursuant to this list, a channel is correlated to a note in accordance with the note allocation assignments. As discussed further below, each channel of the player corresponding to the keyboard receives either (i) no command to play a sample or (ii) a command to play a sample of a particular note.

By way of example, when a note is removed from a previously played group of notes (i.e., the end user's finger is released from a group of notes which had been held by the end user), channels which previously were assigned to the released note are reassigned to the notes still being played. For playing an eight cello section, assignment tables for eight cellos, such as assignment tables 301–308 shown in FIG. 3, would have been loaded into assignment tables memory location 108. If three notes had been played and these had been sounded by eight instruments (e.g., eight separate samples of one cello each), the note allocation processor, with a top weighted assignment table for three notes (e.g., table 303), would have assigned three channels to the highest note, three channels to the middle note and two channels to the lowest note. If the highest note is released by the end user, then the channels which had been assigned to that note must be reassigned to the remaining two notes in order to preserve the orchestral balance. The steps described up to now accomplish this.

In this regard, if the system shown in FIG. 1 were being used for allocating notes among the cellos of an eight cello orchestra section, and if at a particular time three notes were being played, namely C, E and G, with G having the highest pitch and C the lowest, the old note/channel list in memory location 109 would have three channels (e.g. first, second a third cello channels) each assigned note G, three channels (e.g., fourth, fifth and sixth cello channels) each assigned note E, and two channels (e.g. seventh and eighth cello channels) each assigned note C. If the new event is the end user lifting his finger from the G key, the keyboard sends a G note-off signal to the note allocation processor, which receives the new event signal in step 201. In step 202 the CPU determines that this new event is not a note-on signal and proceeds to step 205. The CPU decrements the note counter from three to two. In step 206 the CPU removes G from the notes-on list in memory location 107. The CPU then performs step 207 in which it determines that the value in the counter is in fact greater than zero, and moves to step 209.

In step 209 the CPU sorts the notes in the notes-on list by pitch into a sorted notes-on list. The CPU stores the sorted notes-on list of two notes, E and C (sorted from highest to lowest pitch) in memory location 110.

The CPU next performs step 210. In performing this step, the CPU (i) interrogates either the counter or the notes-on list or the sorted notes-on list to determine how many notes are being played concurrently, and (ii) selects the assignment table which corresponds to that number of notes. Here assignment table 302, for two notes in a cello section, is selected.

Then the CPU performs step 211. For the example discussed here, the predetermined assignment table 302, for two notes played by an eight cello orchestra section provides for four channels playing the higher note and four channels playing the lower note. So, pursuant to this allocation, the CPU in Step 211 consults the sorted notes-on list in memory location 110 and assigns the first through fourth cello channels to play the higher note (here note E), and the fifth through eighth cello channels to play the lower note (here note C). In this step the CPU also creates a new note/channel list which reflects these new channel assignments and stores the new note/channel list in new note/channel list memory location 111.

If the player were of an idealized embodiment, the CPU would now perform a step of causing the note allocation processor to send a set of commands corresponding to each of the note allocations set forth on the new note/channel list to the input of player 103, and player 103 would respond by having each of its respective channels which correspond to the keyboard play the prerecorded sample corresponding to the note assigned to that channel.

However, currently available players are configured so that their respective channels continue playing notes which they have been commanded to play until a note-off signal is received. That is, current players are polyphonic and, for example, once a particular channel has been commanded to play a cello sounding note C, that channel would continue playing the sample of the cello sounding note C even after that channel receives a command to play a cello sounding note E. Such channel would be playing two notes (i.e., playing two samples, one of a cello sounding note C and the other of a cello sounding note E) after receiving the second signal. The present invention takes the configuration of current players into account.

Here a brief explanation of musical terms "hard attack" and "soft attack" would be helpful. The concept of a hard attack or a soft attack is not new in electronic music. The method in which such attacks are invoked as a response to continuing or reassigned notes, as described herein, is new.

In general, a sound (a sampled note in this case) which begins abruptly or with a steep increase in amplitude (i.e., a sudden onset of sound) is said to have a hard-attack. Examples would be such sounds as the plucked beginning of a guitar note, or the hammered-down beginning of a piano note. A sound which commences with a gradual increase in amplitude is said to have a soft attack. Examples would be such sounds as a gently applied bow to a violin string or a softly blown flute note. Hard attack and soft attack are terms familiar to the music business. Many traditional samplers (and synthesizers) allow for control of the attack characteristic, by means of shaping the amplitude envelope of the onset of any given sound. It is also possible to assign control parameters that select attack characteristics.

In the case of the note allocation process described herein, the concern is not with the hard or soft attack nature of the sampled sound. The concern is this: does a given new event comprise a newly-played note (i.e., a note which is not being played on any of the channels of the player (and is therefore not listed in the old note/channel list). If it is, then the player should be commanded to play that newly-played note on the channels assigned that note as a hard attack sound.

However, if the new event comprises the cessation of the playing of a particular note while other note(s) are still being held, then the assignment of notes to channels would essentially be a re-assignment of the released channels to held notes, and a hard attack would be inappropriate. Similarly, even when the new event comprises the addition of a newly-played note to one or more other notes which continue to be sounded (i.e., held), there is likely to be a reassignment of the held notes among the channels. With respect to a channel playing a held note (regardless of whether that channel was that channel which had been playing the note before the new event), a soft attack is required so that the held note does not sound as if it were a freshly-played note. That is, reassigned notes should not sound like new notes being played; they must smoothly appear without drawing attention to themselves.

So after step 211 the CPU performs the compare new note/channel list with old note/channel list subroutine 212, in which the CPU compares the new note/channel list in memory location 111 to the old note/channel list that is stored in memory location 109, on a channel-by-channel basis.

For each channel, one of four possibilities exists:

(i) it is going to continue playing the same note which it is currently playing (i.e., the channel will be playing the same note that it was playing before the new event), in which case the CPU causes no signal to be sent to the player with respect to that channel because, as mentioned above, current players have each of their channels continue to play whatever sample they are playing until a note-off command is received by the player;

(ii) it is going to play a note which is not currently being played by any channel on the note/channel list (i.e., the note is not listed on the old note/channel list), in which event the CPU causes two commands to be sent to the player with respect to that channel, first a note-off command with respect to the note currently being played by that channel and second a note-on command with respect to the new note for that channel, which note-on command is accompanied by a hard-attack instruction;

(iii) it is going to play a note that is new to that channel but was being played by at least one other channel before the new event under discussion (i.e., the note is listed on the old note/channel list), in which case the CPU causes two commands to be sent to the player with respect to that channel, first a note-off command with respect to the note currently being played and second a note-on command with respect to the new note for that channel, which note-on command is accompanied by a soft-attack instruction;

(iv) no note is to be played by the channel, in which case the CPU causes a note-off command to be sent to the player with respect to that channel.

So, in subroutine 212, the CPU performs step 213 with respect to each channel. In this step the CPU queries whether the channel is to be playing the same note as it was playing before the new event. If the answer is "yes," then no signal is sent to that channel. If the answer is "no," then the CPU performs step 214 in which the new note/channel list is queried to see if any note is to be played by that channel.

If the answer is "no," then step 215 is performed, in which the CPU sends a note-off command to the channel commands buffer in memory location 112 with respect to the note which is currently being played by that channel.

If the answer to the query in step 214 is "yes," then step 216 tests to see if the new note on that channel is the same as any notes on the old note/channel list. If the answer is "no," step 217 is performed in which the CPU sends to the channel commands buffer in memory location 112, with respect to that channel, a note-off command with respect to the note that is currently being played on the channel (as listed on the old note/channel list) and a new note-on command, which note-on command includes the identity of the note on the new note/channel list corresponding to the channel being compared, along with a hard attack instruction.

If the answer to the query of step 216 is "yes," step 218 is performed in which in the CPU sends to the channel commands buffer with respect to that channel a note-off command with respect to the note that is currently being played on the channel (as listed on the old note/channel list) and a new note-on command, which note-on command includes the identity of the note on the new note/channel list corresponding to the channel being compared, along with a soft attack instruction.

Alternatively, step 216 could instead test to see if the answer to the query of step 202 is "yes" (or if the new event is a note-on signal). If, with respect to this alternate version of step 216, the answer is "yes," then step 217 is performed as described above, and if the answer is "no," then step 218 is performed as described above.

After each of steps 213, 215, 217 and 218, the CPU performs step 219 in which the CPU determines whether the value of the channel comparison counter is equal to the number of channels on the new note/channel list. (The number of channels on the new note/channel list is the same as the number of instruments in the orchestra section which is being played.) If the answer to the query of step 219 is "no," this means that the comparison of the new note/channel list with the old note/channel list has not been completed with respect to every channel. In which case, the CPU performs step 220 in which the channel comparison counter is incremented by one. Then the CPU returns to step 213 and repeats the portion of the process beginning with that step until the comparison is completed with respect to all of the channels.

If the answer to the query of step 219 is "yes," this means that the comparison of the new note/channel list with the old note/channel list has been completed with respect to every channel. In which case, the CPU performs step 221 in which the CPU (i) causes the note allocation processor to send the commands in the channel commands buffer to the player's input, (ii) writes the new note channel list into the old note/channel list memory location 109 (i.e., the new note/channel list becomes the old note/channel list for the next event), and (iii) sets the channel comparison counter to one.

The setting of the channel comparison counter to one could instead be done as part of step 201 or step 211 any other time prior to entering the compare new note/channel list with old note/channel list subroutine.

In addition, the contents of the channel commands buffer should be erased as part of step 201 or step 211 any other time prior to entering the compare new note/channel list with old note/channel list subroutine.

The system and process described above provides a test for each channel to see if it is playing a held note (i.e., any note appearing on the old note/channel list) and if so, the corresponding channel in the player is commanded to play the note with a soft attack. (If the channel were already playing the same note, then no command need be sent to the player with respect to that channel and that channel would continue to play the same note.) If it is not a held note, then it is a newly-played note, and, as noted above, step 217 provides that the note-on command for that note will include a hard attack instruction. (It has earlier been mentioned that with respect to the playing of a new note, the keyboard may have included additional instructions which are passed through the note allocation processor. Such instructions may override the hard attack instruction provided by step 217.)

Returning now to the discussion of the example of assigning notes to the channels of a system emulating an eight cello orchestra section (in which the CPU performed step 211 by assigning note E to the first through fourth cello channels, and note C to the fifth through eighth cello channels and creating a new note/channel list reflecting these channel assignments and storing the new note/channel list in new note/channel list memory location 113), the CPU next performs step 212. This is the Compare New Note/Channel List with Old Note Channel List Subroutine described above.

The old note/channel list (in memory location 109) and new note channel list (in memory location 111) are as follows:

| Old Note/Channel List | New Note/Channel List |
|---|---|
| Channel No. 1: G | Channel No. 1: E |
| Channel No. 2: G | Channel No. 2: E |
| Channel No. 3: G | Channel No. 3: E |
| Channel No. 4: E | Channel No. 4: E |
| Channel No. 5: E | Channel No. 5: C |
| Channel No. 6: E | Channel No. 6: C |
| Channel No. 7: C | Channel No. 7: C |
| Channel No. 8: C | Channel No. 8: C |

In performing the Compare New Note/Channel List with Old Note Channel List Subroutine, the CPU performs step 213 in which the CPU checks the value of the channel comparison counter and compares the note on the new note/channel list for the channel corresponding to that value with the note on the old note/channel list for same. Since this is the first time that step 213 is being performed since the new event, the value of that counter is one. So, the CPU compares the channel 1 assignments of the old and new note/channel lists. Here the answer to the query of step 213 is "no" (i.e., the notes for channel 1 are not the same for both lists). The CPU then performs step 214 to assure that channel no. 1 does have a note assigned to it pursuant to the new note/channel list. The answer to this query is "yes" and the CPU performs step 216 in which it determines whether the note assigned to channel no. 1 on the new note/channel list is the same as any note on the old note/channel list. The answer to this query is "yes" because, even though note E is "new" to channel no. 1, note E was assigned to at least one channel pursuant to the old note/channel list. The CPU then, pursuant to step 218, sends to the channel commands buffer in memory location 114 with respect to channel 1 a note-off command (i.e., that note G should not be played) and a note-on command (i.e., commanding that channel 1 play note E), which note-on command is accompanied by a soft attack instruction. The CPU then performs step 219, in which the answer to the query of that step is "no" because the number of channels on the new note channel list is eight while the value of the channel comparison counter is only one. The CPU then performs step 220 in which it increments the channel comparison counter by one (i.e., to a value of two).

So, the CPU returns to step 213 in which it performs as described in the paragraph above, this time with respect to channel no. 2. Since channel no. 2 on the new note/channel list is compared to channel no. 2 of the old note/channel list, the results for channel no. 2 are the same as for channel no. 1, except this time when the channel comparison counter is incremented by one in step 219, its value becomes three.

The CPU returns to step 213 in which it performs as described in the paragraph above, this time with respect to channel no. 3. The result is the same as with channels nos. 1 and 2, except this time when the channel comparison counter is incremented by one in step 220, its value becomes four.

The CPU returns to step 213, this time to check if the note assigned to channel no. 4 on the new note/channel list is the same as the note assigned to channel no. 4 on the old note/channel list. Now the answer is "yes" (note E is the note assigned to channel no. 4 on both note/channel lists). Therefore, the CPU proceeds directly to step 219 (i.e., no command with respect to channel no. 4 need be sent to the channel commands buffer). The answer to the query of step 219 is "no" because the number of channels on the new note channel list is eight while the value of the channel comparison counter is four. The CPU then performs step 220 in which it increments the channel comparison counter by one (i.e., to a value of five).

Again the CPU returns to step 213, this time to check if the note assigned to channel no. 5 on the new note/channel list is the same as the note assigned to channel no. 5 on the old note/channel list. The answer is "no," and the CPU performs as described above for channels nos. 1, 2 and 3, except that, pursuant to step 218, the CPU sends note-off command for the note E and a note-on command for playing note C, and, pursuant to step 220, the channel comparison counter is incremented from five to six.

The CPU returns to step 213 in which it performs as described in the paragraph above, this time with respect to channel no. 6. The result is the same as with channel no. 5, except this time when the channel comparison counter is incremented by one in step 220, its value becomes seven.

Once again the CPU returns to step 213, this time to check if the note assigned to channel no. 7 on the new note/channel list is the same as the note assigned to channel no. 7 on the old note/channel list. Because the answer is "yes," the CPU performs as described above in connection with channel no. 4, except that when the CPU performs step 220, it increments the channel comparison counter to eight.

The CPU returns to step 213, this time to check if the note assigned to channel no. 8 on the new note/channel list is the same as the note assigned to channel no. 8 on the old note/channel list. Because the answer is "yes," the CPU performs as described above in connection with channels nos. 4 and 7, except that when the CPU performs step 219, the answer to the query is "yes" (i.e., both (i) the number of channels on the new note channel list and (ii) the value of the channel comparison counter are eight). Instead of performing step 220 after step 219, the CPU performs step 221 in which it (i) causes the note allocation processor to send channel commands from the channel commands buffer to the player (namely, for channel 1, a G note-off command and an E note-on command with soft attack instruction; for channel no. 2, a G note-off command and an E note-on command with soft attack instruction; for channel no. 3, a G note-off command and an E note-on command with soft attack instruction; for channel no. 4, no command (i.e., the player's channel no. 4 will keep playing whatever note it is already playing); for channel no. 5, an E note-off command and an C note-on command with soft attack instruction; for channel no. 6, an E note-off command and an C note-on command with soft attack instruction; for channel no. 7, no command; and for channel no. 8, no command); (ii) writes the new note/channel list into old note/channel list memory location 109 (and erasing what was there before), and (iii) sets the channel comparison counter to one.

At this point the note allocation processor has completed the note allocation process for the event and is ready to process the next event which comes along.

In a contemplated embodiment, the player would be a sampler with each channel of the sampler having a specific library associated with it. For example, for the playing of an eight cello orchestra section, the library for channel no. 1 would include recordings of a first chair cellist playing a set of notes; the library for channel no. 2 would include recordings of a second chair cellist, and so on. With such special libraries, a real orchestra could be even more closely emulated. In this regard, assignment tables could have additional impact, with the most important notes being played by the recordings of the most skilled musicians.

The note allocation processor and player, or the input device, note allocation processor and player, may be manufactured as an integrated whole product. The description set forth above would still apply.

The note allocation processor may be used in connection with live performances or in connection with recording music in studio sessions. In addition, each set of commands which are sent to the channel commands buffer may be recorded automatically and reproduced as music charts or musical scores for orchestration, or for generating stored note-playing data for subsequent generation of synthesized sound or orchestration.

It will be understood that various changes of the details, materials, steps, arrangement of parts and uses which have been herein described and illustrated in order to explain the nature of the invention will occur to and may be made by those skilled in the art, and such changes are intended to be included within the scope of this invention.

We claim the following:

1. A method for assigning notes to be played by a musical synthesizer to a predetermined number of channels of said musical synthesizer, said method including the following steps:

(a) receiving a signal indicating a new note event, wherein a new note event is one of the following two events relating to a particular note; (i) a note-on event comprising the addition of said particular note to the notes being played by the musical synthesizer and (ii) the deletion of said particular note from the notes being played by said musical synthesizer;

(b) determining whether said new note event is a note-on event;

(c) if said new note event is a note-on event, adding said particular note to a notes-on list;

(d) if said new note event is not a note-on event, deleting said particular note from said notes-on list;

(e) determining how many notes are on said notes-on list;

(f) selecting an assignment table corresponding to the predetermined number of channels and how many notes are on said notes-on list;

(g) assigning notes to said channels pursuant to said assignment table and said notes-an list; and (h) sending to said musical synthesizer a set of commands corresponding to the assignment of notes to channels wherein when said new note event is a deletion of said particular note, the method performs the step of assigning a different note from said note-on list to the channel that was previously playing said particular note.

2. The method of claim 1, wherein step (e) is as follows;

(e) determining how many notes are on said notes-on list and if there is not at least one note on said notes-on list, issuing a note-off command to said musical synthesizer for any note currently being played on any channel.

3. The method of claim 1, wherein when the number of notes on said notes-on list is larger than the predetermined number of channels, the method further performs the steps:

identifying certain notes as supplemental notes; and performing additive polyphony to assign said supplemental notes to said channels.

4. The method of claim 1, wherein said assignment table comprises an orchestral algorithm.

5. The method of claim 1, wherein said assignment table comprises a lookup table.

6. The method of claim 1, wherein said assignment table comprises an allocation map.

7. The method of claim 1, wherein said step of assigning notes comprises performing one of a top weighting and a bottom weighting assignment of said notes.

8. The method of claim 1, further comprising the step of sorting said notes-on list in order according to the pitch of each of said note.

9. The method of claim 1, further comprising appending a soft-note instruction to said assigning of a different note.

10. The method of claim 1, wherein step (h) comprises sending to a channel commands buffer a set of commands corresponding to the assignment of notes to channels.

11. A method for assigning notes to be played by a musical synthesizer to a predetermined number of channels of said musical synthesizer, said method including the following steps:

(a) receiving a signal indicating a new note event, wherein a new note event is one of the following two events relating to a particular note: (i) a note-on event comprising the addition of said particular note to the notes being played by the musical synthesizer and (ii) the deletion of said particular note from the notes being played by said musical synthesizer;

(b) determining whether said new note event is a note-on event;

(c) if said new note event is a note-on event, adding said particular note to a notes-on list;

(d) if said new note event is not a note-on event, deleting said particular note from said notes-on list;

(e) determining how many notes are on said notes-on list;

(f) selecting an assignment table corresponding to the predetermined number of channels and how many notes are on said notes-on list;

(g) assigning notes to said channels pursuant to said assignment table and said notes-on list; and (h) sending to said musical synthesizer a set of commands corresponding to the assignment of notes to channels;

wherein when said note event is a note-on event, said set of commands further comprises a hard-note instruction.

12. The method of claim 11, wherein when the number of notes on said notes-on list is larger than the predetermined number of channels, the method further performs the steps:

identifying certain notes as supplemental notes; and performing additive polyphony to assign said supplemental notes to said channels.

13. The method of claim 11, wherein said assignment table comprises an orchestral algorithm.

14. The method of claim 11, wherein said assignment table comprises a lookup table.

15. The method of claim 11, wherein said assignment table comprises an allocation map.

16. The method of claim 11, wherein said step of assigning notes comprises performing one of a top weighting and a bottom weighting assignment of said notes.

17. The method of claim 11, further comprising the step of sorting said notes-on list in order according to the pitch of each of said note.

18. A method for dynamically assigning motes to be played by a musical synthesizer, comprising:

providing at least one note assignment table comprising a preferential weighting note assignment;

setting a predetermined number of channels for playing assigned notes;

determining the number of notes to be played at a current instance;

using said note assignment table to assign each of said notes to a respective channel of said predetermined number of channels; and, wherein said preferential weighting note assignment table is one of a bottom weighting note assignment table and a top weighting note assignment table.

19. The method for dynamically assigning notes according to claim 18, wherein providing at least one note assignment table comprises providing a plurality of note assignment tables and wherein the method further comprises selecting one of said note assignment tables to assign each of said notes.

20. The method for dynamically assigning notes according to claim 18, further comprising the step of sorting said notes in order according to the pitch of each of said notes.

21. The method for dynamically assigning notes according to claim 18, wherein when the number of notes is larger than the predetermined number of channels, the method further comprises:

identifying certain notes as supplemental notes; and performing additive polyphony to assign said supplemental notes to selected ones of said predetermined number of channels.

22. The method for dynamically assigning notes according to claim 21, further comprising the step of sorting said notes-on list in order according to the pitch of each of said notes.

23. The method for dynamically assigning notes according to claim 18, wherein said assignment table comprises an orchestral algorithm.

24. The method for dynamically assigning notes according to claim 18, wherein said assignment table comprises a lookup table.

25. The method for dynamically assigning notes according to claim 18, wherein said assignment table comprises an allocation map.

26. The method for dynamically assigning notes according to claim 18, wherein each of said channels represent a single musical instrument.

27. The method for dynamically assigning notes according to claim 18, wherein each of said channels represent a sub-section of an orchestral section.

28. A method for dynamically assigning notes to be played by a musical synthesizer, comprising:

providing at least one note assignment table;

setting a predetermined number of channels for playing assigned notes;

determining the number of notes to be played at a current instance;

using said note assignment table to assign each of said notes to a respective channel of said predetermined number of channels; and, further comprising providing one of a hard-note and soft-note instruction to each one of said predetermined number of channels.

29. The method for dynamically assigning notes according to claim 28, wherein said note assignment table is one of a bottom weighting note assignment table and a top weighting note assignment table.

30. A note allocation processor operable in conjunction with an input device and a note player, said note player having a predetermined number of channels, said note allocation processor comprising:

an input for receiving note signals firm said input device;

an output for providing note assignment to said note player;

a note counter;

at least one note assignment table comprising a preferential weighting note assignment;

a central processor preprogrammed to obtain the number of notes indicated in said note counter and assign each note to a respective one of said channels according to said note assignment table and provide one of a hard-note and soft-note instruction to each one of said channels.

31. The note allocation processor of claim 30, further comprising a channel comparison counter indicating the number of channels having been assigned a note.

32. The note allocation processor of claim 30, further comprising a sorted note list memory, and wherein said central processor sorts said notes according to the pitch of said notes and stores a sorted note list in said sorted note list memory.

33. The note allocation processor of claim 30, further comprising a notes-on list memory storing all notes to be played at a given instance.

34. The note allocation processor of claim 30, further comprising a notes-on list memory storing all notes to be played at a given instance, and wherein when the number of notes to be played exceeds said predetermined number of channels, said central processor designates selected ones of said notes on as being supplemental notes.

35. The note allocation processor of claim 30, wherein each of said note signals represents one of: a single musical instrument, an orchestral section, and a non-musical instrument audio sound.

* * * * *